United States Patent [19]

Henry

[11] 4,005,863

[45] Feb. 1, 1977

[54] TENNIS RACKETS

[76] Inventor: Dana R. Henry, 200 W. Mason St., Apt. 14, Santa Barbara, Calif. 93101

[22] Filed: Oct. 4, 1974

[21] Appl. No.: 512,095

[52] U.S. Cl. ..... 273/73 D

[51] Int. Cl.[2] ..... A63B 51/02

[58] Field of Search ..... 273/73 R, 73 C, 73 D, 273/73 E, 67 R, 96 D, 76

[56] References Cited

UNITED STATES PATENTS

| | | | |
|---|---|---|---|
| 1,531,778 | 3/1925 | Gallaudet | 273/73 D |
| 1,694,360 | 12/1928 | Larned | 273/73 D X |
| 2,080,642 | 5/1937 | Timpe | 273/73 D |
| 2,847,790 | 8/1958 | Tjernagel | 273/73 D X |
| 2,969,984 | 1/1961 | Presnick | 273/73 R |
| 3,744,529 | 7/1973 | Jorda et al. | 273/73 D X |
| 3,926,431 | 12/1975 | DeLorean | 273/73 D |

FOREIGN PATENTS OR APPLICATIONS

| | | | |
|---|---|---|---|
| 128,626 | 8/1948 | Australia | 273/73 D |
| 428,582 | 5/1935 | United Kingdom | 273/76 |
| 1,314 | 1/1884 | United Kingdom | 273/73 D |
| 25,019 | 11/1911 | United Kingdom | 273/73 D |

*Primary Examiner*—Richard J. Apley

*Attorney, Agent, or Firm*—Naylor, Neal & Uilkema

[57] ABSTRACT

Tennis rackets having racket strings which are not round. The strings are provided with a cross-section of a geometrical shape such as to provide each string with two or more edges. The strings are also provided with a helical twist along their length during their formation by extrusion; they are also provided with approximately one-half of a helical twist per unit of length corresponding to the distance between adjacent cross-over points of the strings and at such points there is surface to surface rather than edge to edge engagement.

3 Claims, 5 Drawing Figures

TENNIS RACKETS

An object of the invention is to provide new and improved tennis racket strings operable to provide increased friction between ball and strings and thereby impart more spin to the ball and consequently more control over its path of flight.

A further object of the invention is to provide new and improved racket strings adapted to anchor the racket string grid face in better fashion than is possible with the present racket strings of cylindrical cross-section.

Other objects and advantages of the invention will be apparent from the following description taken in conjunction with the drawing forming part of this specification, and in which.

Figure 1:
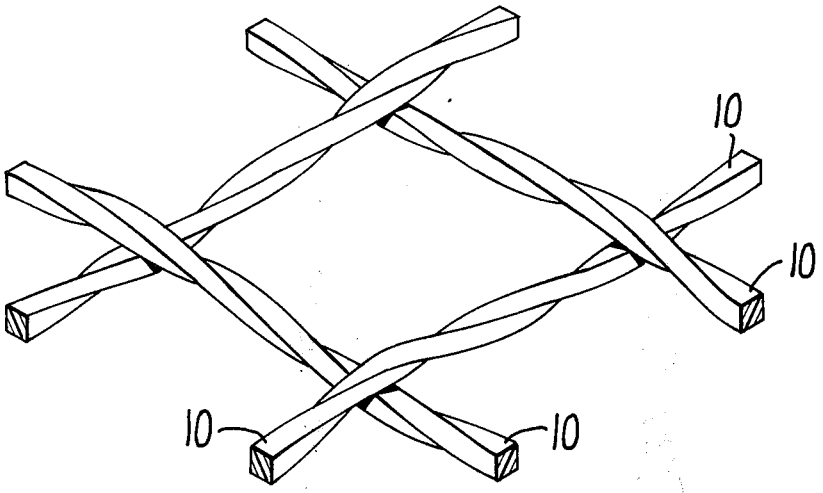
FIG. 1 is a view in perspective on one rectangle of a tennis racket string grid face incorporating the improved racket string of the invention.
Figure 2:
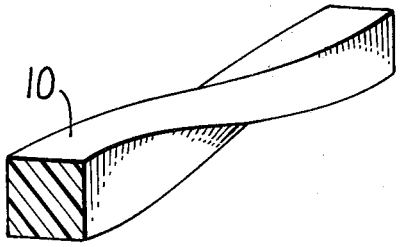
FIG. 2 is an enlarged view of the string of FIG. 1.
Figure 3:
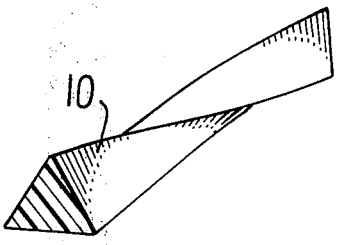
FIG. 3 is a view similar to that of FIG. 2 but wherein the new improved racket string is triangular in cross-section.
Figure 4:
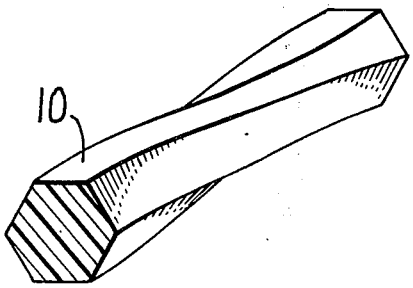
FIG. 4 is a view similar to those of FIGS. 2 and 3 but showing the improved racket string as having a hexagonal cross-section.
Figure 5:
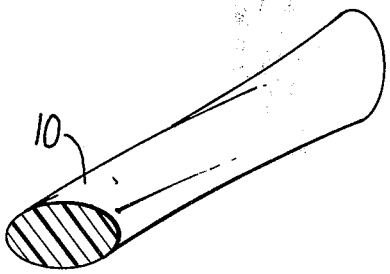
FIG. 5 is a view showing the string with an elliptical cross-section.

The improved racket strings are shaped, as by extrusion, to have a non-round, or angular, cross-section which provides the string with two or more longitudinal edges. The strings 10 of FIGS. 1 and 2 are square in cross-section and have four edges; the string of FIG. 3 is triangular in cross-section and has three edges; the string of FIG. 4 is hexagonal in cross-section and has six edges; and the string of FIG. 5 is elliptical in cross-section and has two edges. The string may be provided with any reasonable number of alike peripheral surface portions which define the same number of edges.

The improved racket strings of the invention are furthermore provided with a longitudinally twisted configuration, i.e. a helical or spiraled effect, imparted to the string in an extrusion process, whereby the strings appear to have a one-half turn per tennis racket grid face unit, as illustrated in FIG. 1 and are free of internal strain tending to return them to a non-helical condition. The new, angular, spiraled racket strings serve to anchor the racket grid face to a better and more desirable degree than is possible with the present round strings because of surface portion to surface portion rather than edge to edge engagement between the strings at the cross-over loci of the two sets of strings.

The provision of angular edges lengthwise of the strings furnishes an enhanced capability in the racket of imparting more spin to the ball than is possible with the present round strings. This is because the improved strings increase the friction between the ball and the strings to provide more ball spin. Also, the angular edges cause greater ball deformation at points of contact with the racket head, thereby providing a more responsive ball, the flight characteristics of which, e.g. arching and dipping in the line of flight, begin more quickly and are more pronounced.

What is claimed is:

1. A tennis racket comprising a frame and a racket string grid face attached to the frame, said grid face consisting of two mutually perpendicular sets of equally spaced, interlaced, alike, extruded strings, said strings having angular cross-sections and peripheral surfaces formed by alike, intersecting surface portions defining at least two edges, said surface portions and edges being helically shaped by extrusion to thereby be free of internal strain tending to return them to a non-helical condition.

2. The tennis racket of claim 1, said strings having approximately one-half of a helical turn per unit of length corresponding to the distance between adjacent strings of a set.

3. The tennis racket of claim 2, said strings being arranged to have surface portion to surface portion engagement at the cross-over loci of the two sets.

* * * * *